US008468958B2

(12) United States Patent
Giabanis

(10) Patent No.: US 8,468,958 B2
(45) Date of Patent: Jun. 25, 2013

(54) FASTENABLE FOOD DISH

(76) Inventor: Alexander P. Giabanis, Clifton Park, NY (US)

( * ) Notice: Subject to any disclaimer, the term of this patent is extended or adjusted under 35 U.S.C. 154(b) by 175 days.

(21) Appl. No.: 12/909,386

(22) Filed: Oct. 21, 2010

(65) Prior Publication Data

US 2012/0097683 A1 Apr. 26, 2012

(51) Int. Cl.
*A47B 85/00* (2006.01)

(52) U.S. Cl.
USPC ..... 108/98; 248/229.25; 108/26

(58) Field of Classification Search
USPC ..... 248/229.25, 447.2, 231.71, 235; 297/153, 297/174 R, 174 CS, 251, 252; 220/23.89, 220/23.87, 23.8, 23.86; 206/557, 562, 563; 108/25, 26, 90, 92, 93, 97, 98, 101, 27, 42, 108/44, 46, 50.11
See application file for complete search history.

(56) References Cited

U.S. PATENT DOCUMENTS

| | | | | | |
|---|---|---|---|---|---|
| 9,304 | A | * | 10/1852 | Conger | 84/172 |
| 1,242,785 | A | * | 10/1917 | Eldridge | 108/25 |
| 1,247,112 | A | * | 11/1917 | Holmberg et al. | 108/139 |
| 1,347,123 | A | * | 7/1920 | Mann | 108/97 |
| 1,522,079 | A | * | 1/1925 | Read | 248/456 |
| 2,184,994 | A | * | 12/1939 | Dyke | 131/235.1 |
| 2,709,904 | A | * | 6/1955 | Boughton | 220/23.8 |
| 2,842,413 | A | * | 7/1958 | Simmons | 108/142 |
| 2,935,209 | A | * | 5/1960 | Fritz | 108/25 |
| D208,317 | S | * | 8/1967 | Broder | D7/552.1 |
| 3,656,681 | A | * | 4/1972 | Goings | 206/561 |
| 4,908,066 | A | | 3/1990 | Taylor | |
| 5,842,671 | A | | 12/1998 | Gibbs | |
| 6,017,085 | A | * | 1/2000 | LaCroix et al. | 297/173 |
| 6,216,605 | B1 | * | 4/2001 | Chapman | 108/26 |
| 6,371,470 | B1 | * | 4/2002 | Ward | 269/289 R |
| 6,484,989 | B1 | | 11/2002 | Connery | |
| 6,766,912 | B1 | | 7/2004 | Gibbs | |
| 7,290,746 | B1 | * | 11/2007 | Macias et al. | 248/311.2 |
| 7,303,172 | B2 | | 12/2007 | Rich | |
| 7,740,312 | B2 | * | 6/2010 | Johnson, Jr. | 297/217.6 |
| 7,931,245 | B2 | * | 4/2011 | Mills et al. | 248/231.71 |
| 7,992,714 | B1 | * | 8/2011 | Devault et al. | 206/564 |
| 2002/0178972 | A1 | * | 12/2002 | McNeil | 108/42 |
| 2004/0251255 | A1 | * | 12/2004 | Azzar | 220/23.87 |
| 2005/0029840 | A1 | * | 2/2005 | Heck et al. | 297/148 |
| 2005/0126445 | A1 | * | 6/2005 | Guard et al. | 108/25 |

* cited by examiner

*Primary Examiner* — Janet M Wilkens
(74) *Attorney, Agent, or Firm* — Arnold de Guzman

(57) ABSTRACT

According to at least one embodiment, a fastenable food dish for adjustably engaging a table, the fastenable food dish comprising a base having a bottom surface for placement on the table, an upper surface opposite the bottom surface, and a well defined in the upper surface; at least one clamp attached to the bottom of said base, the clamp having an adjustable pad facing the bottom surface of said base for engaging the table between the adjustable pad and the bottom surface of said base; and a tray removably seated in the well of said base, the tray defining at least one upper-facing food compartment.

16 Claims, 4 Drawing Sheets

FASTENABLE FOOD DISH

FIELD OF THE INVENTION

The present invention relates to a fastenable food dish. More particularly, the present invention relates to a fastenable food dish for adjustably engaging a table.

BACKGROUND OF THE INVENTION

During many family dinners children remove their plates from the table. For example, children receiving food frequently lift their plates from the table, leaving food all over the floor, soiling their clothes and other persons.

While children's food dishes have proven successful in transitioning children to eating solid food, they have not alleviated the burden of the children covering themselves and other persons with food. This can cause adults frustration. Such frustration can lead to an increased likelihood of poor parenting as well as substantial amounts of time being wasted cleaning the home.

Accordingly, there remains a need for a fastenable food dish which keeps the food on the table and off the child, floor, and other persons.

SUMMARY

According to at least one embodiment, a fastenable food dish for adjustably engaging a table, the fastenable food dish comprising a base having a bottom surface for placement on the table, an upper surface opposite the bottom surface, and a well defined in the upper surface; at least one clamp attached to the bottom of said base, the clamp having an adjustable pad facing the bottom surface of said base for engaging the table between the adjustable pad and the bottom surface of said base; and a tray removably seated in the well of said base, the tray defining at least one upper-facing food compartment.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

The invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a fastenable food dish (herein described as "the device") 10, which provides a means for removably fastening the device 10 onto a regular table 62.

Figure 1:
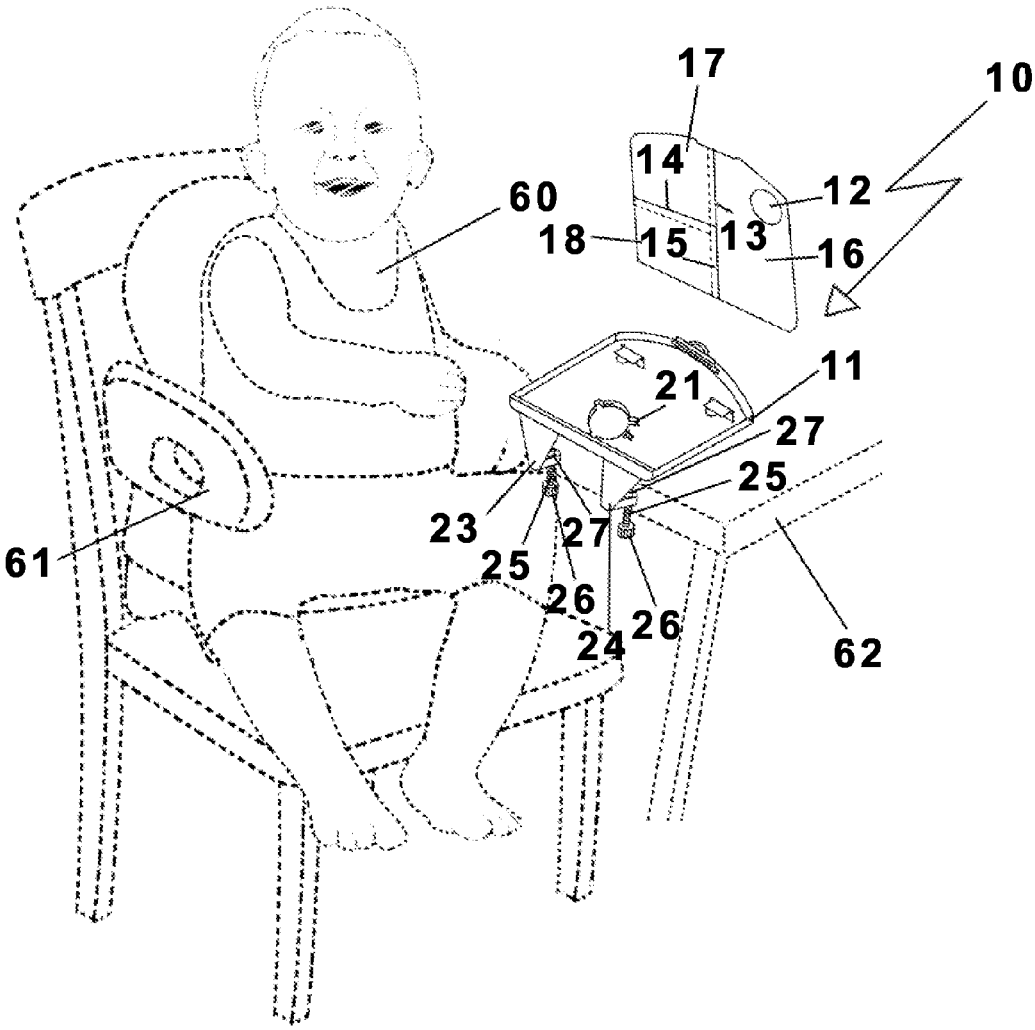
FIG. 1 is an environmental perspective view of a fastenable food dish 10, according to a preferred embodiment of the present invention; and, FIG. 2A is a perspective top view of the fastenable food dish 10, according to the preferred embodiment of the present invention; and, FIG. 2B is a perspective bottom view of the fastenable food dish 10, according to the preferred embodiment of the present invention; and, FIG. 3A is a perspective top view of a removable tray 40, according to a first alternate embodiment of the present invention; and, FIG. 3B is a perspective top view of a fastenable tray base 50, according to a second alternate embodiment of the present invention.

Referring now to FIG. 1, an environmental perspective view of the device 10, according to the preferred embodiment of the present invention, is disclosed. The device 10 is depicted as removably fastened onto a table 62 and located in front of a child 60 seated on a chair 61. The device 10 comprises a removable tray wherein an upper portion comprises a first divider 13, a cup compartment 12, a second divider 14, separating a first food compartment 16 from a second food compartment 17 and a third food compartment 18. A third divider 15 separates the second food compartment 17 from the third food compartment 18. A lower portion of the base 11 includes locking tabs 21 for a removable bowl. A lower portion of the base 11 comprises an integral first clamp 23 and a corresponding similar integral second clamp 24, wherein each clamp 23, 24, comprises a threaded spindle 25. The upper end of the threaded spindle 25 comprises a pad 27 and the lower end of the spindle 25 comprises a knob 26 which allows the spindle 25 to be manually rotated. The pair of threaded spindles 25 are envisioned to be made of plastic, aluminum or stainless steel, whereas the pair knobs 26 are made of plastic and permanently bonded onto the bottom end portion of each threaded spindle 25. Each pad 27 comprises of a non-marring face made of material such as rubber, NYLON®, or TEFLON® and is pivotally fastened onto the top end portion of each threaded spindle 25.

Figure 2A:
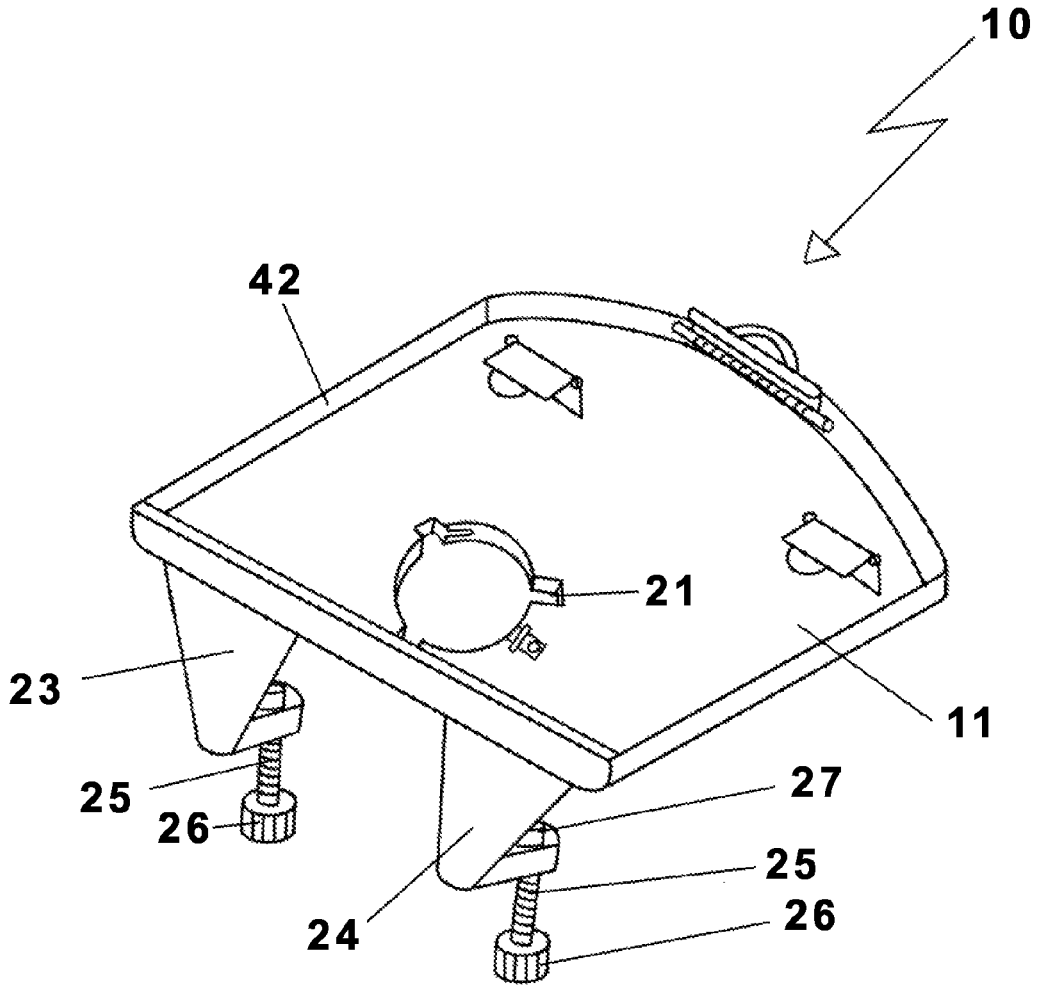

Referring now to FIG. 2A, a perspective top view of the device 10, according to the preferred embodiment of the present invention, is disclosed. A lower portion of the base includes locking tabs 21 for receiving a removable bowl. A lower portion of the base 11 comprises an integral first clamp 23 and a corresponding similar integral second clamp 24, wherein each clamp 23, 24, comprises a threaded spindle 25. The upper end of the threaded spindle 25 comprises a pad 27 and the lower end of the spindle 25 comprises a knob 26 which allows the spindle 25 to be manually rotated. The pair of threaded spindles 25 are envisioned to be made of plastic, aluminum or stainless steel, whereas the pair knobs 26 are made of plastic and permanently bonded onto the bottom end portion of each threaded spindle 25. Each pad 27 comprises of a non-marring face made of material such as rubber, NYLON®, or TEFLON® and is pivotally fastened onto the top end portion of each threaded spindle 25. A lower portion of the base 11 has a border 64.

Figure 2B:
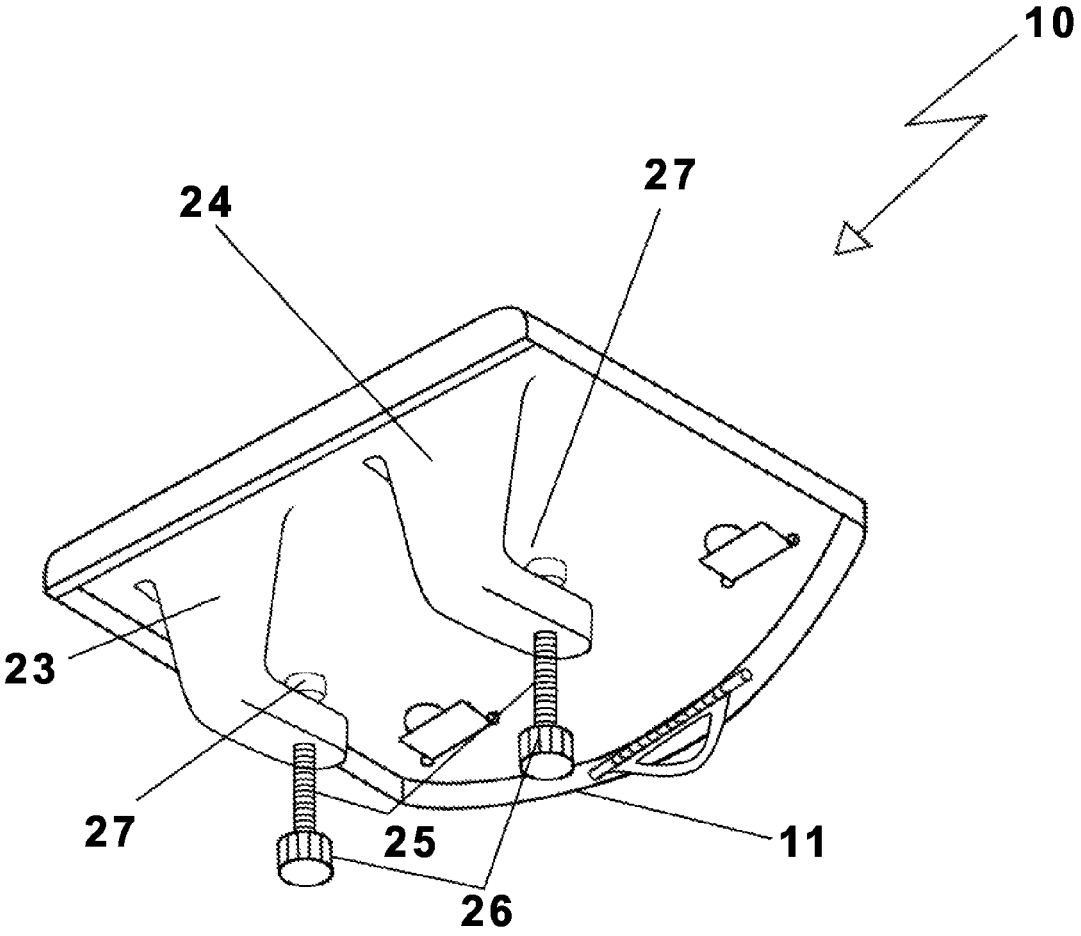

Referring now to FIG. 2B, a perspective bottom view of the device 10, according to the preferred embodiment of the present invention, is disclosed. The bottom portion of the base 11 comprises the integral clamps 23, 24, each comprising the assembly of the threaded spindle 25, the knob 26 and the pad 27.

Figures 3A, 3B:
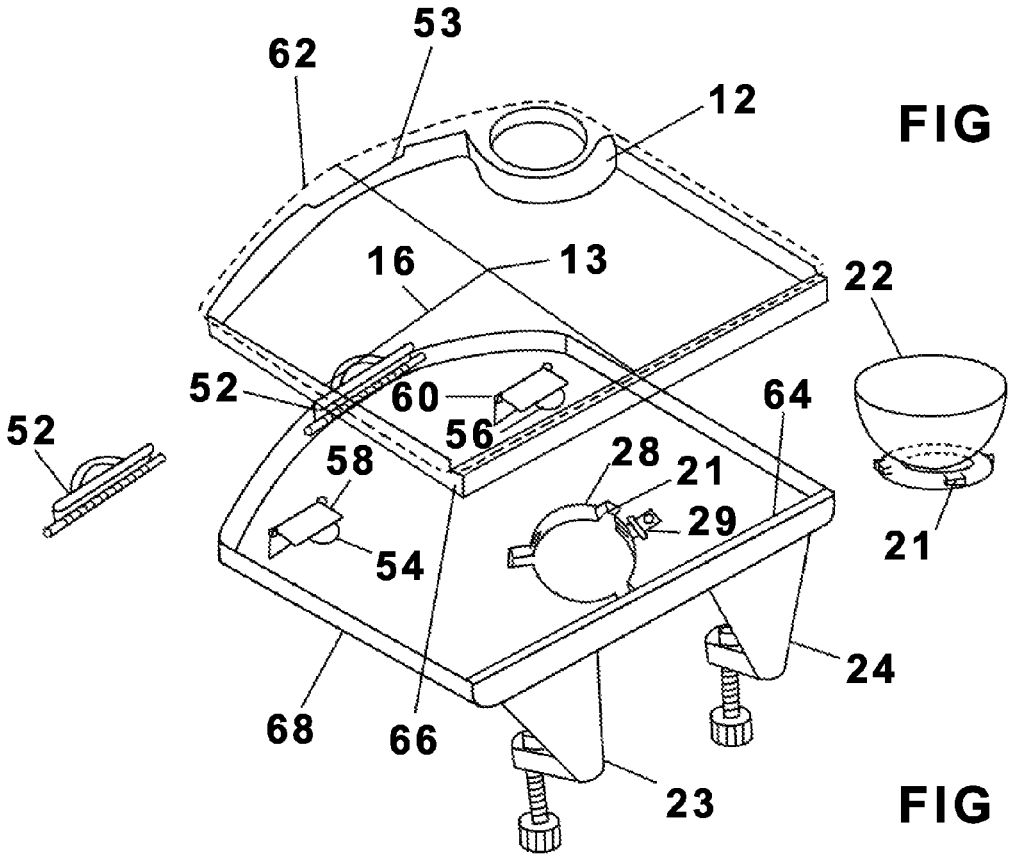

Referring now to FIG. 3A, a perspective top view of a removable tray, according to a first alternate embodiment of the present invention, is disclosed. The removable tray comprises a border 62, 66 and food area divider members 13, 16 which are similar to those comprised within the device 10, and are therefore designated by like symbols. The removable tray is envisioned as a molded a micro-wave compatible plastic product.

Referring now to FIG. 3B, a perspective top view of a fastenable tray base, according to a second alternate embodiment of the present invention, is disclosed. The fastenable tray base further comprises a recess 54, 56 for inserting one's finger to raise the plastic flaps 58, 60 for use with a high chair tray. The fastenable base further comprises a removable bowl 22. The bowl 22 includes locking tabs 21 which allow the bowl 22 to be attached when inserted. The fastenable tray base further comprises a recessed bowl receiving area 28 and a button hinge 29 which, when pressed raises the locking tab and allows the bowl to be turned and removed. A lower portion of the base comprises an integral first clamp 23 and a corresponding similar integral second clamp 24. A fastenable food dish further comprises a base with a pivoting hinge 52 with a button for removing the tray. A fastenable food dish further comprises a recessed lip 53 for receiving the spring loaded pivot hinge 52 on the docking station to lock the tray into place. The fastenable base further comprises a border 64,68.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training After initial purchase or acquisition of the device 10, it would be installed as indicated in FIG. 1.

The method of utilizing the device 10 may be achieved by performing the following steps: grasping the knob 26 at the first clamp 23 location with a first hand; rotating the spindle 25 counterclockwise until a space between the pad 27 and the underside surface portion of the tray 11 is sufficient to accommodate the thickness of the top of the table 62; repeating similar steps at the second clamp location; sliding the tray 11 onto a chosen location at the table 62; retaining the location of the tray 11 with a second hand; using the first hand to alternately rotate each knob 26 into a clockwise direction; securing the location of the tray by tightening each spindle 25 in the clockwise direction; serving the child 60; following the installing steps in a reverse order to uninstall the device 10; cleaning the tray 11; and, storing the device 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A fastenable food dish for adjustably engaging a table, the fastenable food dish comprising:

a base having a bottom surface for placement on the table, an upper surface opposite the bottom surface, and a well defined in the upper surface;

at least one clamp attached to and integral with the bottom surface of said base, the clamp having an adjustable pad facing the bottom surface of said base for engaging the table between the adjustable pad and the bottom surface of said base;

a tray removably seated in the well of said base, the tray defining at least one upper-facing food compartment; and a removable bowl, wherein the base is configured to receive the removable bowl;

wherein the receivable bowl includes a locking tab that mates with receiving indents in the base;

wherein the base includes a button hinge;

where the button hinge when pressed raises the locking tab and allows the bowl to be turned in one direction and removed.

2. A fastenable food dish according to claim 1, wherein said clamp includes:

a first member attached to and extending away from the bottom surface of said base; and a second member attached to the first member and extending parallel to the bottom surface of said base.

3. A fastenable food dish according to claim 2, wherein the first member of said clamp is attached to and is integral with the bottom surface of said base.

4. A fastenable food dish according to claim 2, wherein said clamp includes:

a threaded spindle rotatably engaging the second member; and a knob attached to a first end of the threaded spindle, wherein the pad is attached to a second end of the threaded spindle opposite the knob such that the knob and pad are disposed on opposite sides of the second member.

5. A fastenable food dish according to claim 1, further comprising a second clamp attached to the bottom of said base, the clamp having an adjustable pad facing the bottom surface of said base for engaging the table between the adjustable pad and the bottom surface of said base.

6. A fastenable food dish according to claim 1, wherein the tray includes a cup compartment.

7. A fastenable food dish according to claim 1, wherein the tray includes at least a first divider.

8. A fastenable food dish according to claim 1, wherein the tray includes at least a food compartment.

9. A fastenable food dish according to claim 1, wherein the tray is defined by a raised border.

10. A fastenable food dish according to claim 1, wherein the base includes at least one recessed area.

11. A fastenable food dish according to claim 10, wherein the base includes at least one plastic flap.

12. A fastenable food dish according to claim 1, wherein the base includes a recessed bowl receiving area.

13. A fastenable food dish according to claim 1, wherein the base includes a pivoting hinge with a button for removing the tray.

14. A fastenable food dish according to claim 13, wherein the base includes a pivoting hinge that is spring loaded.

15. A fastenable food dish according to claim 1, wherein the tray includes a recessed lip for receiving a spring loaded pivot hinge on the base to lock the tray into place.

16. A fastenable food dish for adjustably engaging a table, the fastenable food dish comprising:

a base having a bottom surface for placement on the table, an upper surface opposite the bottom surface, and a well defined in the upper surface;

at least one clamp attached to the bottom surface of said base, the clamp having an adjustable pad facing the bottom surface of said base for engaging the table between the adjustable pad and the bottom surface of said base;

a tray removably seated in the well of said base, the tray defining at least one upper-facing food compartment; and a removable bowl, wherein the base is configured to receive the removable bowl;

wherein the receivable bowl includes a locking tab that mates with receiving indents in the base;

wherein the base includes a button hinge;

wherein the button hinge, when pressed, raises the locking tab and allows the bowl to be turned in one direction and removed.

* * * * *